US006101901A

United States Patent [19]

Daigle

[11] Patent Number: 6,101,901

[45] Date of Patent: Aug. 15, 2000

[54] DUAL-PAWL FULL ENGAGEMENT REVERSIBLE RATCHET WRENCH

[75] Inventor: Odee Paul Daigle, Garland, Tex.

[73] Assignee: The Stanley Works, New Britain, Conn.

[21] Appl. No.: 09/371,554

[22] Filed: Aug. 10, 1999

[51] Int. Cl.[7] ..... B25B 13/46

[52] U.S. Cl. ..... 81/60; 81/63.1

[58] Field of Search ..... 81/58, 60, 62, 81/59.1, 63.2, 63.1, 63

[56] References Cited

U.S. PATENT DOCUMENTS

| | | | |
|---|---|---|---|
| 4,491,043 | 1/1985 | Dempsey et al. | 81/58 |
| 4,765,449 | 8/1988 | Peters | 192/43.1 |
| 4,807,500 | 2/1989 | Main | 81/63.1 |
| 5,058,463 | 10/1991 | Wannop | 81/57.29 |
| 5,477,757 | 12/1995 | Maresh | 81/63.2 |
| 5,568,751 | 10/1996 | Lee | 81/63 |

*Primary Examiner*—David A. Scherbel
*Assistant Examiner*—Hadi Shakeri
*Attorney, Agent, or Firm*—Standley & Gilcrest LLP

[57] ABSTRACT

A reversible ratchet wrench utilizing two pawls that mesh with teeth inside a housing. The design allows for engagement of all the teeth on a pawl with all the teeth in the housing. The invention provides for reduced stress on the individual teeth of the pawl as compared with a traditional reversible ratchet wrench. Smaller components of less expensive material may subsequently be utilized, allowing for a reduction in housing size.

Both a round head reversible ratchet wrench and a pear head reversible ratchet wrench are contemplated. The wrenches of the present invention share several common components. Interchangeability is desirable due to the reduction in required components, and the reduced costs associated therewith.

23 Claims, 14 Drawing Sheets

DUAL-PAWL FULL ENGAGEMENT REVERSIBLE RATCHET WRENCH

BACKGROUND AND SUMMARY OF THE INVENTION

Reversible ratchet wrenches are well known and are commonly sold in a wide variety of sizes. However, regardless of size or available features, all such ratchet wrenches may generally be classified as one of two types: the round head ratchet wrench, or the pear (oval) head ratchet wrench. Under either classification such a ratchet wrench will possess several similar characteristics such as: the ability to transfer torque from the wrench handle to a fastener; the ability to ratchet when the wrench handle is rotated in the opposite direction; the capability of reversing the direction of the torque and ratcheting strokes; and a means for attachment to sockets, extensions, and other drive tools.

A round head ratchet wrench is generally smaller in size than a pear head ratchet wrench, and thus may better fit into tighter workspaces. A ratchet wrench generally has a handle for transmitting torque, and a housing that contains the moving, internal parts of the ratchet mechanism. In a round head ratchet wrench, teeth are often formed around the inner circumference of the housing. A reversible pawl is commonly employed in such a wrench. The pawl is generally designed to engage the housing teeth during rotation of the wrench handle in one direction, while allowing the pawl to ratchet across the housing teeth during rotation of the wrench handle in the opposite direction.

In a pear head ratchet wrench, a toothed drive wheel is generally utilized to engage a reversible pawl, providing torque transmission in one direction and ratcheting in the other direction. The main disadvantage of the pear head ratchet wrench is its housing size. Additionally, the components of a pear head ratchet wrench and the components of a round head ratchet wrench are not generally interchangeable.

A serious disadvantage of both types of ratchet wrenches is the limited number of pawl teeth that generally engage the housing teeth or drive wheel teeth respectively. When fewer teeth are engaged, there is less total shear area available across the teeth to resist the forces resulting from the torque applied to the wrench handle. As a consequence of such design, high stress levels are placed on the individual teeth that are engaged. To accommodate these high stress levels, the internal components of the ratchet wrench are often fabricated from expensive, exotic materials that generally require heat treating to achieve the necessary strength and durability.

One aspect of the present invention is to provide a reversible ratchet wrench wherein a majority, or, preferably all of the pawl teeth are engaged during the torque-transmitting stroke of the wrench. Engagement of the whole of the pawl teeth with either the housing teeth or the drive wheel teeth respectively, distributes the shear forces over a larger area, reducing the stresses on the individual teeth. This design permits a reduction in individual component size, which allows for a reduction in overall housing size. Additionally, because the individual teeth are no longer required to endure such high stress levels, the components may be produced from more conventional and less costly materials.

Another aspect of the present invention is to produce a round head ratchet wrench and a pear head ratchet wrench that can utilize a substantial number of common components. Such a situation would be advantageous due to the reduction in required individual components, and the reduced costs associated therewith.

The present invention contemplates both a round head and a pear head reversible ratchet wrench employing two pawls of preferably conical shape, for transmitting operator applied torque from the wrench handle to the fastener.

A round head reversible ratchet wrench is provided in one embodiment of the present invention. In a preferred embodiment, the round head reversible ratchet wrench has a handle, which may be permanently or removably affixed to a housing of substantially round shape. The housing is provided to contain the internal, moving parts of the wrench, which are preferably held together by means of a retaining screw. Teeth are formed around the inner circumference of the housing for engaging one of two pawls. One end of a main drive is inserted through the first pawl and into the housing. The other end of the main drive may be releasably attached to sockets, extensions, or other drive tools. A second pawl is inserted into the other side of the housing. A selector is provided for reversing the ratcheting direction of the wrench. Rotating the selector brings one pawl into engagement with the teeth in one side of the housing, while simultaneously releasing the other pawl from engagement with the teeth in the other side of the housing.

An important feature of the round head reversible ratchet wrench of the present invention is that the shape of the pawls and the housing allows for engagement of all the teeth on a respective pawl when the pawl is in contact with the housing. Engagement of all the pawl teeth, with the housing teeth, allows the forces exerted on the pawl to be distributed across all of the pawl teeth, thereby reducing the stress levels on each individual tooth.

In another embodiment of the present invention, a pear head reversible ratchet wrench is contemplated. In a preferred embodiment, the pear head reversible ratchet wrench has a handle that may be permanently or removably affixed to a housing. The configuration of the housing in this embodiment of the invention is referred to in the art as "pear shaped." The housing is provided to contain the internal, moving parts of the wrench. Teeth are formed around the inner circumference of the housing for engaging each one of two pawls. One end of a main drive is inserted through the first pawl and into the housing. The other end of the main drive may be releasably attached to sockets, extensions, or other drive tools. A second pawl is inserted into the other side of the housing. A shifter is located in the housing for reversing the ratcheting direction of the wrench. The shifter is designed to allow a button to protrude from one of either sides of the housing. Pressing one side of the button shifter brings one pawl into engagement with the teeth in one side of the housing, while simultaneously releasing the second pawl from engagement with the teeth in the other side of the housing. Pressing the opposite side of the button shifter will reverse the position of the respective pawls.

An important feature of the reversible pear head ratchet wrench of the present invention is that the shape of the pawls and the housing allows for engagement of all the teeth on a respective pawl when the pawl is in contact with the housing. Engagement of all the pawl teeth with the housing teeth allows the forces exerted on the pawl to be distributed across all of the pawl teeth, thereby reducing the stress levels on each individual tooth.

BRIEF DESCRIPTION OF THE DRAWINGS

The invention and its attendant objects and advantages will become better understood upon reading the following description of the preferred embodiments in connection with the following drawings, wherein.

DETAILED DESCRIPTION OF THE PREFERRED EMBODIMENTS

Figures 1, 1A:
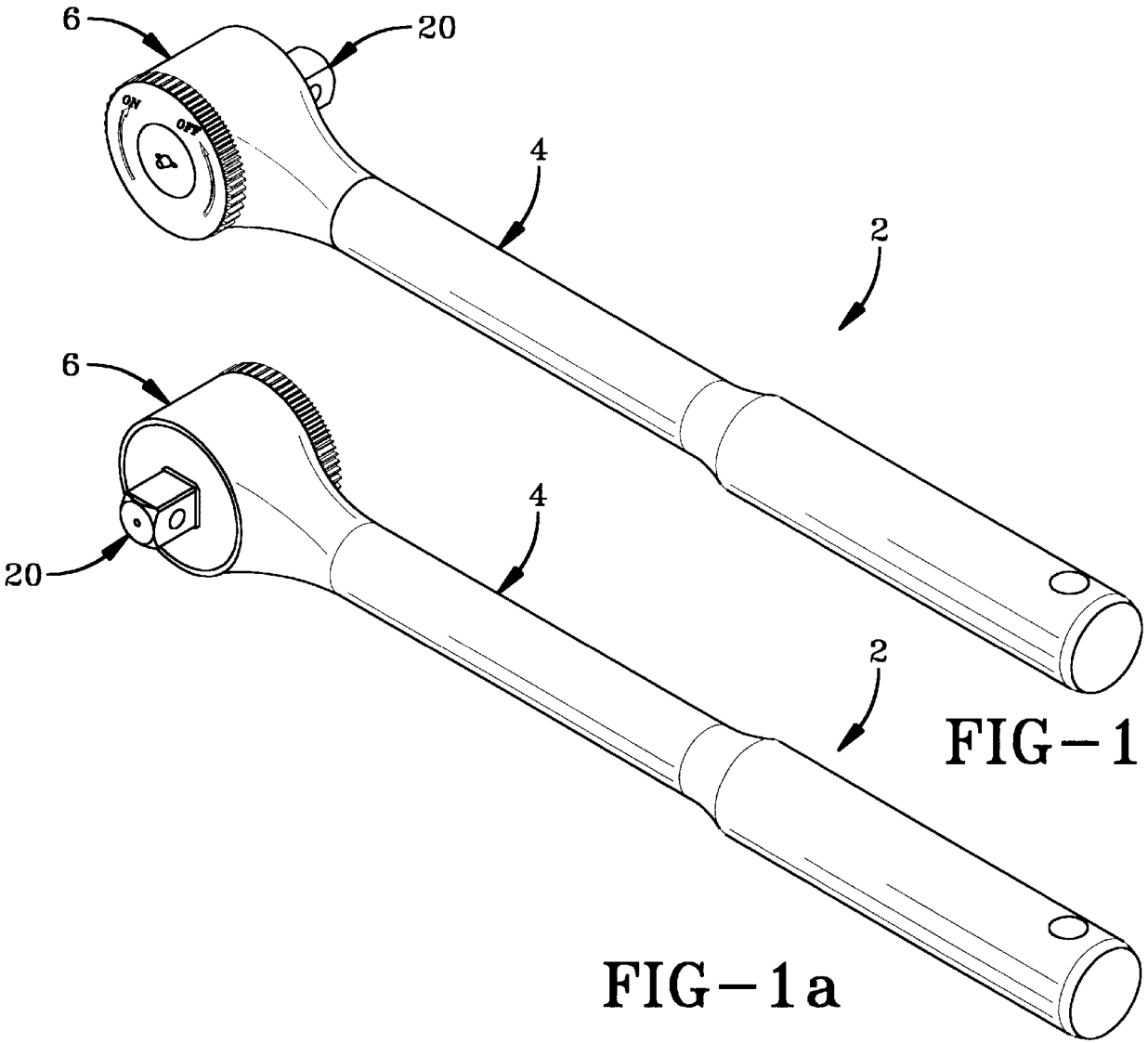
FIG. 1 shows an isometric view of the assembled, reversible round head ratchet wrench of the present invention.
FIG. 1*a* shows a second isometric view of the assembled, reversible round head ratchet wrench of the present invention.

One preferred embodiment of the present invention contemplates a reversible round head ratchet wrench (round head wrench). Two views of the assembled round head wrench 2 are shown in FIGS. 1 and 1*a*. The round head wrench 2 has a handle 4, which may be permanently or removably affixed to a housing 6. The handle 4 is provided to apply torque to a fastener, while the housing 6 functions to contain the internal components of the round head wrench 2.

In FIGS. 1 and 1*a*, a main drive 20 (FIGS. 3 and 4) can be seen protruding from one side of the housing 6 of the round head wrench 2. The external portion of the main drive 20 is provided to releasably attach to sockets, extensions, and other drive tools. In a preferred embodiment, the opposite side of the housing 6 adjoins a selector dial 70 (FIGS. 3 and 9) used to reverse the direction of the round head wrench 2.

Figure 2:
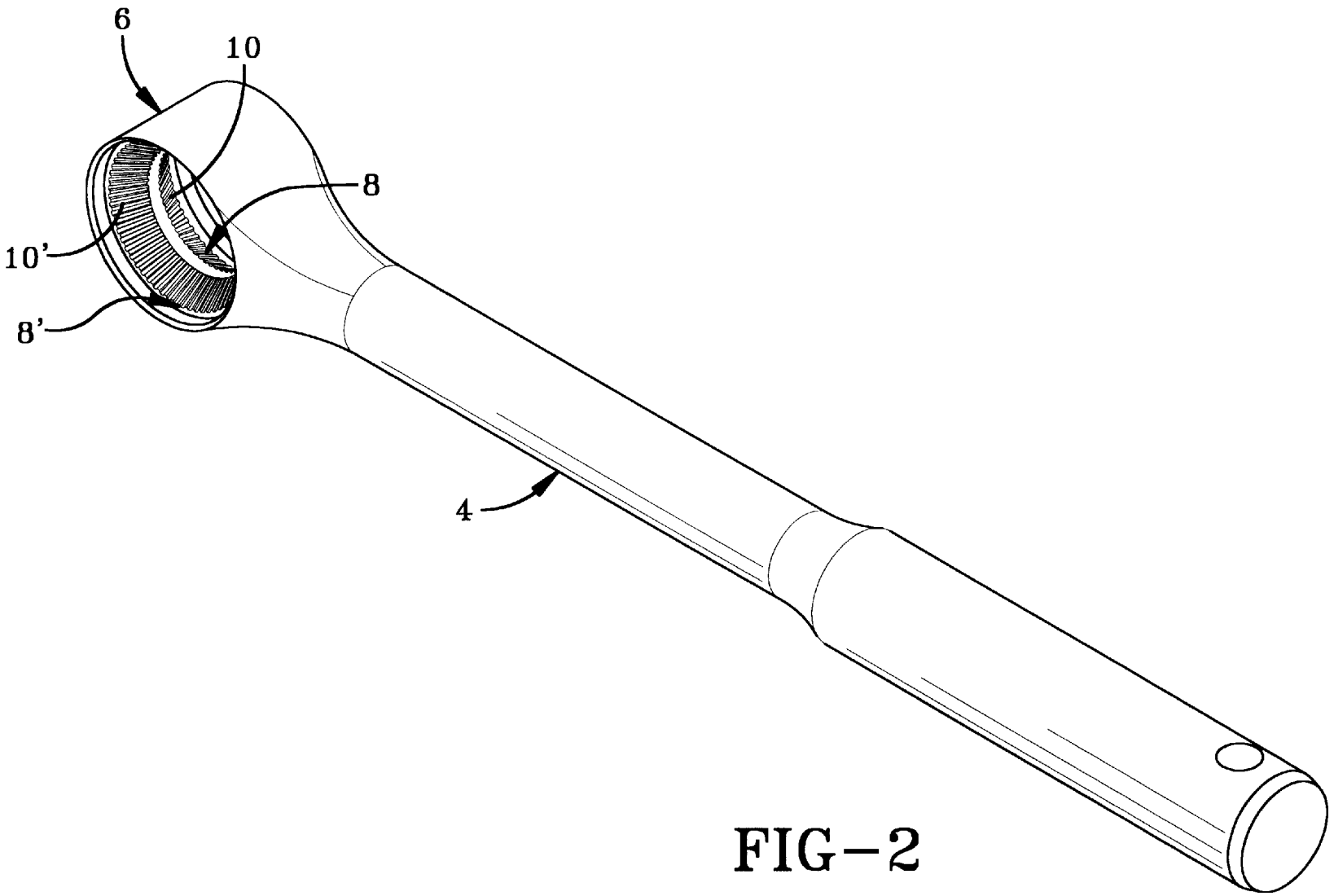
FIG. 2 is a disassembled view showing the handle and housing of the reversible round head ratchet wrench.

The internal configuration of the housing 6 can be seen in the disassembled view of the round head wrench 2 depicted in FIG. 2. The internal portion of the housing 6 has opposing chambers 8, 8' of preferably conical shape, aligned such that the larger diameter of each chamber 8, 8' is toward the outside of the housing 6. There are teeth 10, 10' formed about the inner circumference of the respective chambers 8, 8'.

Referring again to FIG. 3, an exploded assembly view of the round head wrench 2 of the present invention may be observed. As previously discussed, there is a main drive 20, a first portion 22 of which is inserted into the housing 6, and a second portion 24 of which protrudes from the housing for releasable attachment to sockets, extensions, or other drive tools. An enlarged view of the main drive 20 can be seen in FIG. 4.

Figure 3:
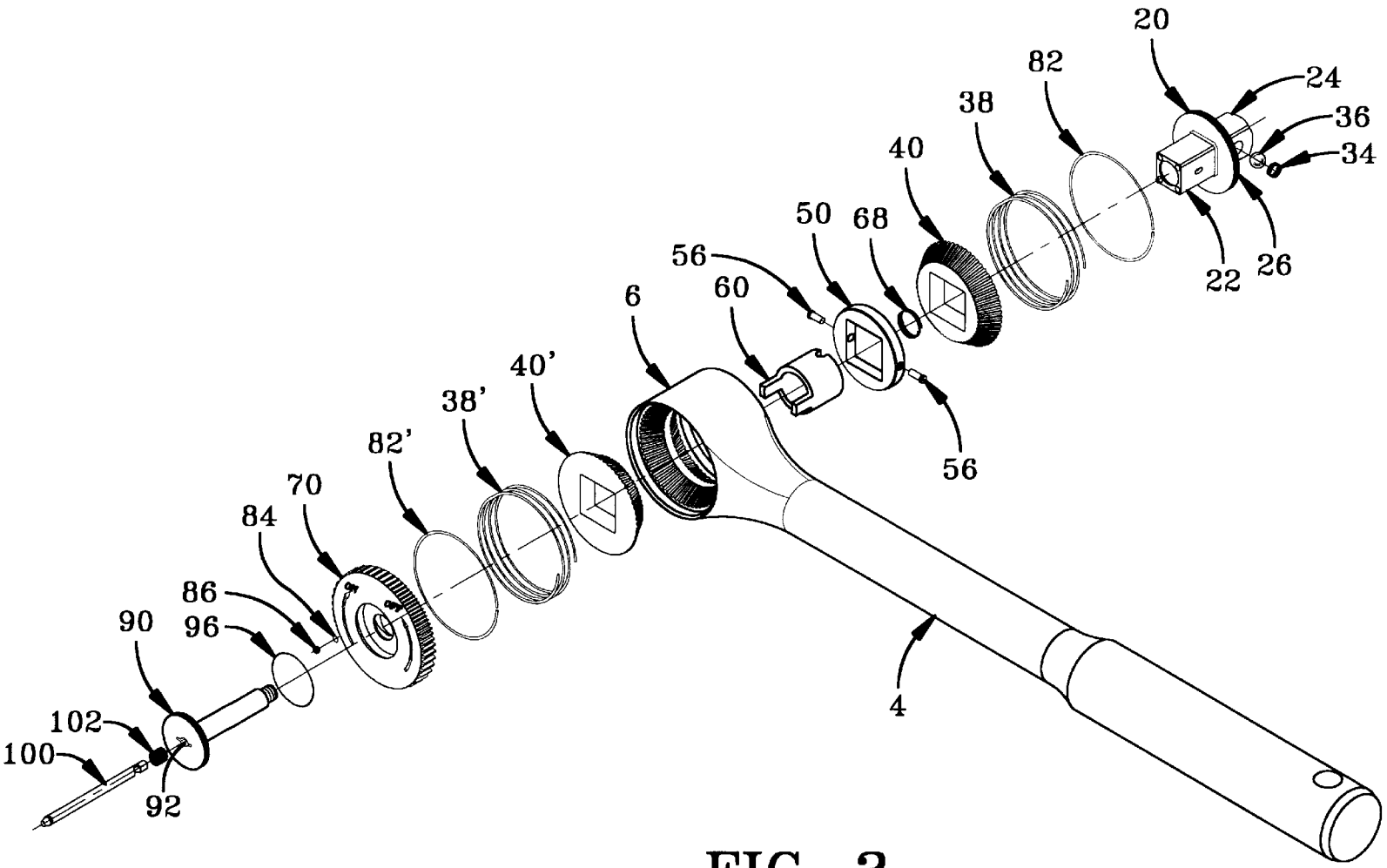
FIG. 3 is an exploded assembly view illustrating the individual components of the reversible round head ratchet wrench.
Figure 9:
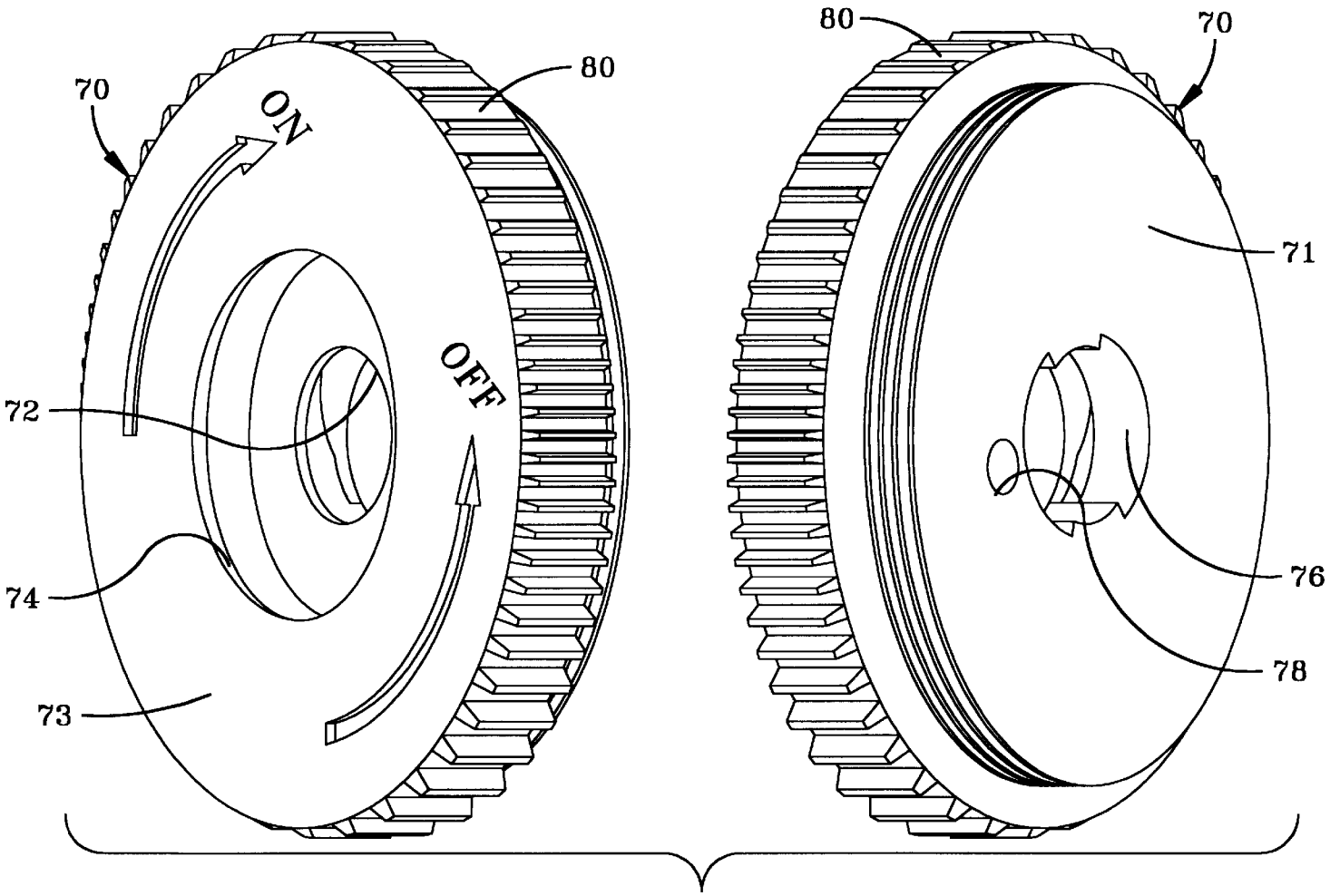
FIG. 9 shows two views of a selector dial, which allows an operator to reverse the direction of the reversible round head ratchet wrench.

The first portion 22 of the main drive 20 is preferably of square or rectangular configuration, but could also have some other polygonal shape. The first portion 22 of the main drive 20 contains a bore 28, of some diameter, centered within the end of the first portion 22. The bore 28 extends along the length of the first portion 22 to some depth less than the overall length of the main drive 20. A portion of the bore 28 more interior to the main drive 20 is threaded for receiving a drive-retaining device 90 (FIG. 3), while a portion of the bore 28 more exterior to the main drive 20 is formed to receive a shifter biasing member 68 (FIG. 3). There are preferably at least four cavities 30 located at predetermined intervals around the bore 28. The cavities 30 are shaped and located to receive a portion of a detention ball 84 (FIG. 3) located in the selector dial 70 (FIGS. 3 and 9).

The second portion 24 of the main drive 20 is also preferably of square or rectangular shape, as would be recognized as standard by one skilled in the art for attachment to sockets, extensions, and other drive tools. As is common, the second portion 24 of the main drive 20 may contain a spring 34 and ball bearing 36 (FIG. 3) to assist in retention of any attached components.

The main drive 20 includes a housing cover portion 26, preferably in the shape of a disk of some thickness, which serves to separate the first portion 22 from the second portion 24, as well as to seal one side of the housing 6 upon assembly. To further insulate the housing 6 and internal components from the outside environment, the housing cover portion 26 of the main drive 20 may be fitted with an o-ring 82 (FIG. 3).

Figure 5:
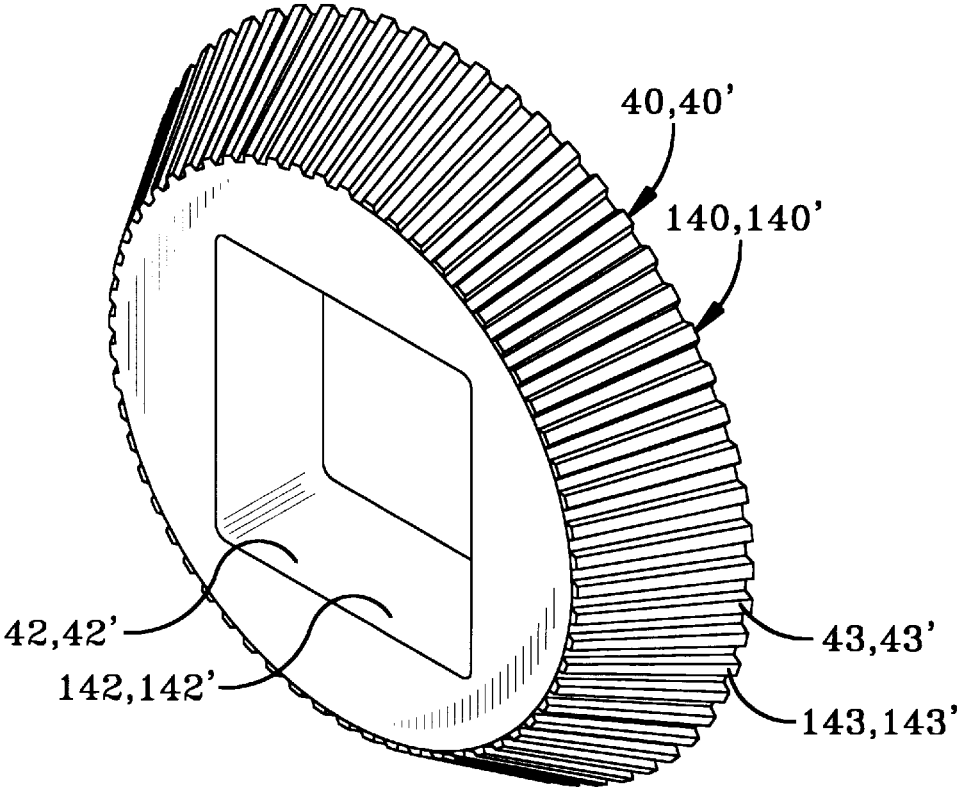
FIG. 5 depicts an enlarged view of a pawl employed in both the reversible round head ratchet wrench and the reversible pear head ratchet wrench of the present invention.

Two identical pawls 40, 40', as illustrated in FIGS. 3 and 5, are provided to transfer torque from the handle 4 to the main drive 20. The pawls 40, 40' are preferably of conical shape, and are sized to mate with the chambers 8, 8' in the housing 6, such that each of the pawl teeth is engaged with a coinciding tooth in the respective chambers.

Figure 10:
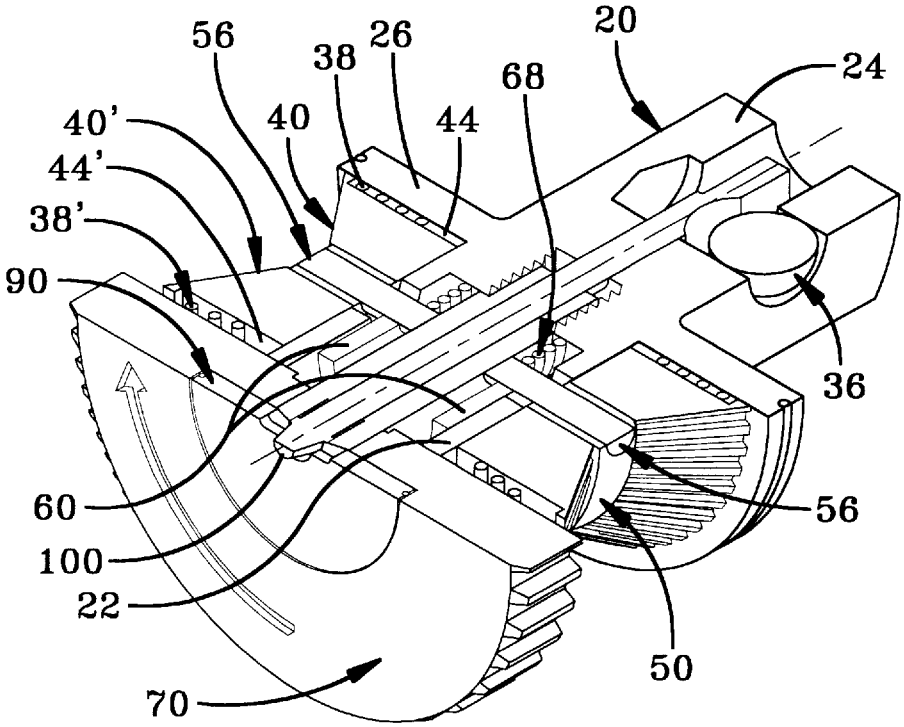
FIG. 10 is a section-view illustrating the position of the internal components when the reversible round head ratchet wrench is set to apply torque in a clockwise direction.
Figure 11:
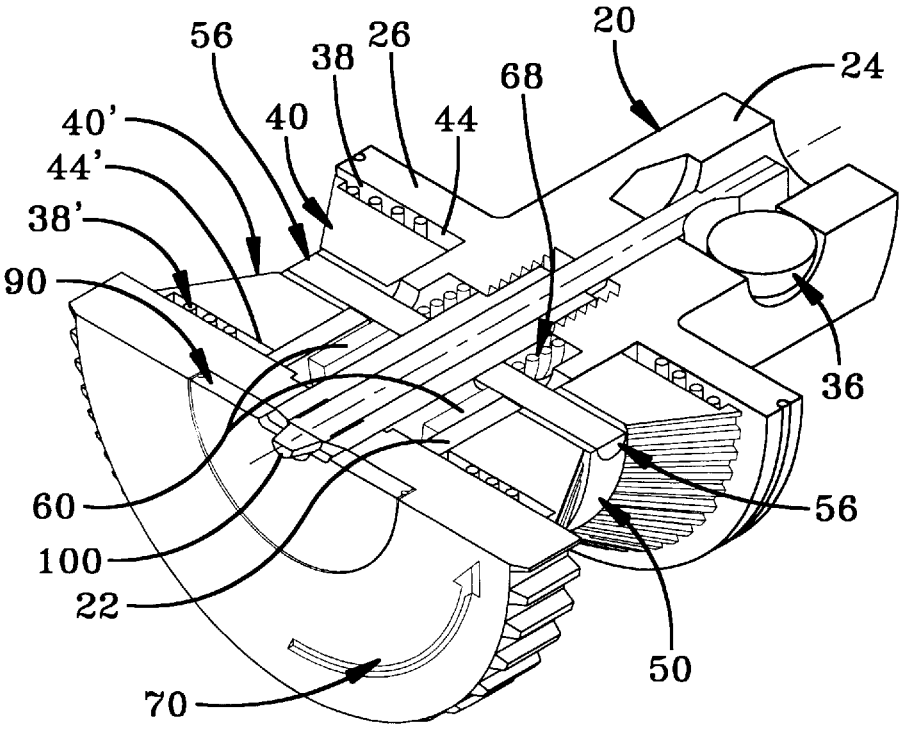
FIG. 11 is a section-view illustrating the position of the internal components when the reversible round head ratchet wrench is set to apply torque in a counter-clockwise direction.

FIG. 5 illustrates the pawls 40, 40' in a preferred embodiment of the round head wrench 2, in which the pawls 40, 40' contain respective holes 42, 42' passing axially through their centers. Although the holes 42, 42' are preferably of square shape, they may also adopt some other polygonal form. The shape of the holes 42, 42' is chosen to match the shape of the first portion 22 of the main drive 20, such that the pawls 40, 40' may move axially, but not rotatably on the first portion 22 of the main drive 20. Each pawl 40, 40' preferably has a recessed cavity 44, 44' (FIGS. 10 and 11) in its larger diameter side. The cavities 44, 44' are of a diameter less than the larger outside diameter of the pawls 40, 40', such that a thin cylindrical wall is formed. The cavities act to contain the circumferential expansion of a pawl-biasing member 38, 38' (FIGS. 3, 10, and 11).

Although a multitude of tooth profiles may be acceptable, preferably the teeth on the pawls 40, 40' and the teeth 10, 10' in the chambers 8, 8' of the housing 6 are of a buttress tooth profile. The buttress tooth profile is well known in the art, and is shown in detail in FIG. 6. Each tooth of the buttress tooth profile has both a flat surface 46 and an angled surface 48. The flat surface 46 is considered the load-carrying surface, while the angled surface 48 is considered the ratcheting surface. The opposing orientation of the pawls 40, 40' of the present invention dictates that the load-carrying surfaces of each pawl will face in opposite directions. This allows the torque applying direction and the ratcheting direction of the round head wrench 2 to be reversed by disengaging one pawl, while engaging the other.

A first pawl-biasing member 38, such as a spring, passes over the first portion 22 of the main drive 20 to abut the housing cover portion 26. The first portion 22 of the main drive 20 penetrates the hole 42 in the first pawl 40. The first pawl 40 is installed on the first portion 22 of the main drive 20, such that the cavity 44 in the first pawl 40 traps the first pawl-biasing member 38 against the housing cover portion 26 of the main drive 20.

Figure 7:
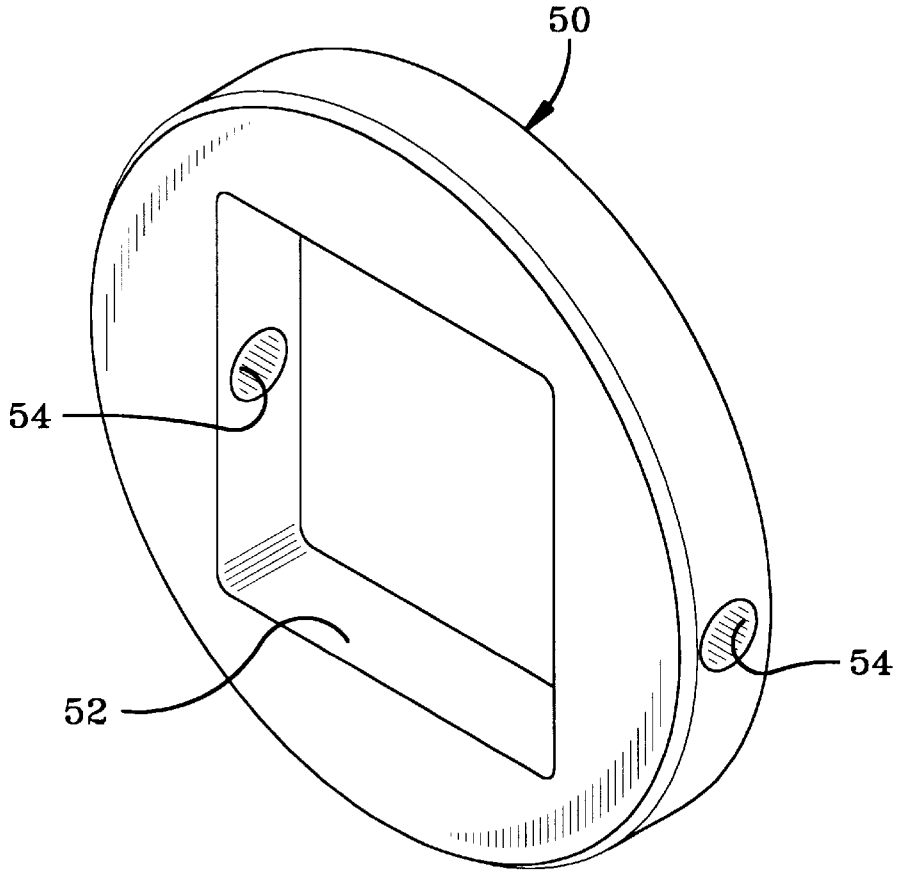
FIG. 7 shows an enlarged view of a shifter yoke employed in the reversible round head ratchet wrench.

Referring again to FIG. 3, a shifter yoke 50 is slidably installed over the first portion 22 of the main drive 20 to lie against the other side of the first pawl 40. As shown in the enlarged view of FIG. 7, the shifter yoke 50 is preferably a disk of some thickness, containing an axial hole 52 of similar size and shape to the hole 42 in the first pawl 40. There is also a second hole 54 oriented perpendicular to the axial hole 52 and passing through a diameter of the shifter yoke 50, such that the second hole 54 is parallel to the wrench handle 4 when the shifter yoke is properly installed on the main drive 20. The second hole 54 passes through the axial hole 52, separating the second hole 54 into two portions.

Referring again to FIG. 4, a slot 32 occurs in the first portion 22 of the main drive 20 and is located to be aligned with the second hole 54 in the shifter yoke 50 when the shifter yoke 50 is properly installed on the first portion 22 of the main drive 20. The slot 32 passes through the bore 28, separating the slot 32 into two portions. Each portion of the slot 32 in the main drive 20 and the hole 54 in the shifter yoke 50 is designed to receive and retain a shifter yoke pin 56 (FIG. 3). The shifter yoke pins 56 fix the first pawl-biasing member 38, first pawl 40, shifter biasing member 68, and shifter yoke 50 to the first portion 22 of the main drive 20. The shape of the slot 32 allows for axial displacement of the shifter yoke 50 along the first portion 22 of the main drive 20.

Figure 8:
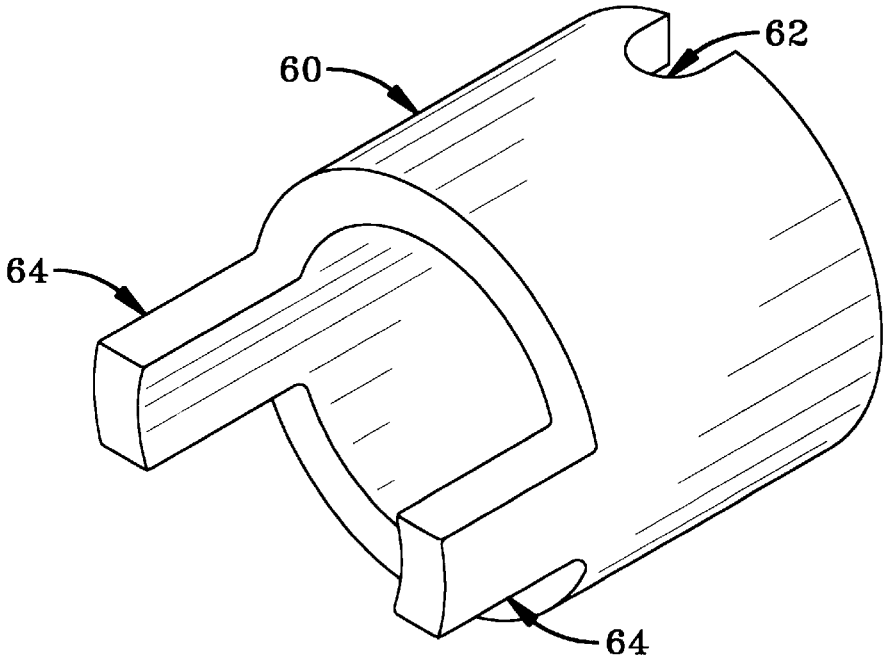
FIG. 8 is an enlarged view of a shifter used for axially displacing the shifter yoke of FIG. 7 during reversal of the reversible round head ratchet wrench.

A shifter biasing member 68 (FIG. 3), such as a spring, is provided to reside within the bore 28 of the main drive 20. A shifter 60 for reversing the ratcheting direction of the round head wrench 2 is depicted in the enlarged view of FIG. 8. The shifter 60 is inserted at least partially into the bore 28 in the first portion 22 of the main drive 20, such that it adjoins the shifter biasing member 68. The shifter 60 is preferably of cylindrical construction, and may or may not be hollow. The shifter 60 is of an outside diameter which allows insertion into the bore 28. The end of the shifter 60 that resides in the bore 28 contains an arcuate notch 62 along a first diameter, the notch 62 being of a diameter and orientation to engage with the shifter yoke pins 56 installed in the shifter yoke 50 and main drive 20. The other end of the shifter 60 has two lobes 64 of some length protruding axially from opposite ends of a second diameter. Preferably, the second diameter is oriented to be perpendicular to the first diameter followed by the notch 62. The lobes 64 are furnished to engage with an internal cam 76 (FIG. 9) in the back of the selector dial 70, which is installed on the opposite side of the housing 6 from that occupied by the main drive 20.

Referring again to FIG. 3, the assembly consisting of: the main drive 20, first pawl-biasing member 38, first pawl 40, shifter yoke 50, shifter biasing member 68, shifter yoke pins 56, and shifter 60, may be inserted through one side of the housing 6. The shifter 60 could be inserted from the opposite side of the housing. The assembly is installed such that the first pawl 40 contacts the teeth 10 in the first chamber 8 of the housing 6.

A second pawl 40', preferably identical to the first pawl 40, is placed into the opposite side of the housing 6 and onto the section of the first portion 22 of the main drive 20 which protrudes into the second chamber 8' of the housing 6. The second pawl 40' mates with the second chamber 8' in the housing 6, such that each of the pawl teeth is engaged with a tooth in the second chamber 8' of the housing 6. A second pawl-biasing member 38' also fits over the first portion 22 of the main drive 20 protruding into the second chamber 8', and adjoins the second pawl 40'.

In a preferred embodiment of the round head wrench 2, a selector dial 70, two views of which are shown in FIG. 9, is employed for selecting a ratcheting direction. The selector dial 70 traps the second pawl-biasing member 38' against the second pawl 40'. The selector dial 70 is preferably a disk of some thickness, with an axial hole 72 through its center. A first side 71 of the selector dial 70 is adjacent to the housing 6, and has an internal cam 76 formed in the axial hole 72. The internal cam 76 serves to act on the lobes 64 protruding from the shifter 60. There is a counterbore 74 located in a second side 73 of the selector dial 70. The counterbore 74 is of a depth less than the total thickness of the selector dial 70, and is designed to receive a drive-retaining device 90 (FIG. 3), which is used to hold the internal components of the round head wrench 2 together. The selector dial 70 may be fitted with an o-ring 82' (FIG. 3) for further sealing one side of the housing 6 from the outside environment.

Figure 4:
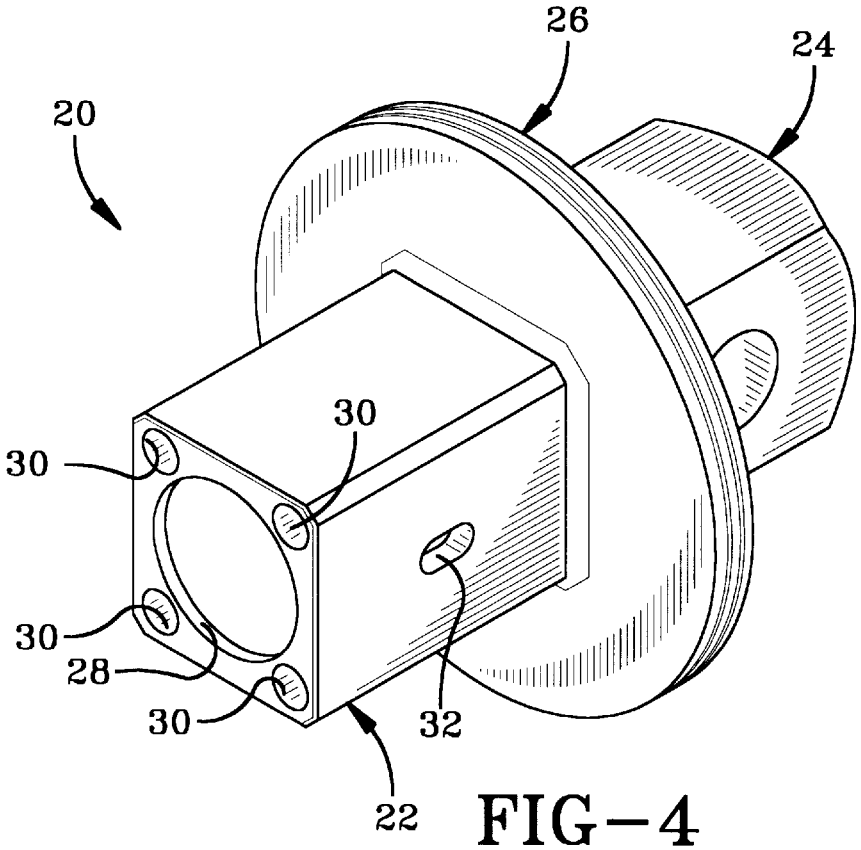
FIG. 4 is an enlarged view of the main drive utilized in the reversible round head ratchet wrench.

Preferably, the selector dial 70 also contains at least one cavity 78 in its first side 71 for housing a detention device, such as a detention ball 84 and detention spring 86 (FIG. 3). The detention ball 84 and detention spring 86 are positioned such that after reversing the ratchet direction by rotation of the selector dial 70, the detention ball 84 will be in contact with one of the mating cavities 30 located in the end of the main drive 20 (FIG. 4). This design prevents any inadvertent rotation of the selector dial 70 by releasably coupling the selector dial to the main drive 20, yet still allows the operator to easily rotate the selector dial 70 for reversing the direction of the round head wrench 2. The outer circumference of the selector dial 70 may be also be textured or knurled for providing a better gripping surface.

FIG. 3 depicts a preferred embodiment of the round head wrench wherein the drive-retaining device 90, such as the screw shown, passes through the selector dial 70 and threads into the bore 28 in the first portion 22 of the main drive 20. The drive-retaining device 90 functions to hold the housing 6, selector dial 70, main drive 20, pawls 40, 40', pawl-biasing members 38, 38', detention ball 84, detention spring 86, shifter 60, and shifter yoke 50 together. The drive-retaining device 90 may be fitted with an o-ring 96 (FIG. 3) for sealing the counterbore 74 in the selector dial 70 from the outside environment. The drive-retaining device 90 preferably has a shoulder or similar structure to prevent malfunctioning of the round head wrench 2 due to over-tightening. The drive-retaining device 90 may also have an axial hole 92 through its length for allowing the passage of a quick-release shaft 100.

In one embodiment of the round head wrench 2, a quick release mechanism, as shown in FIG. 3, may be installed in the round head wrench 2. Quick release mechanisms are well known in the art for releasing sockets, extensions and other drive tools from a ratchet drive, and therefore will not be discussed in detail here. The quick-release mechanism may consist of a quick release shaft 100, and a spring 102.

During normal operation of the round head wrench 2, the selector dial 70 is facing the operator. As depicted in the section view of FIG. 10, turning the selector dial 70 clockwise sets the round head wrench 2 to apply torque during clockwise rotation of the handle 4. Clockwise rotation of the selector dial 70 causes the internal cam 76 to axially displace the shifter 60 some predetermined distance toward the second portion 24 of the main drive 20. The shifter 60 is prevented from rotational movement by its engagement at the opposite end with the shifter yoke pins 56 in the shifter yoke 50. The shifter yoke 50 is restrained from rotational movement by the first portion 22 of the main drive 20. Because the shifter 60 is coupled to the shifter yoke 50 in this manner, the axial displacement of the shifter 60 is transferred to the shifter yoke 50. As the shifter yoke 50 slides along the first portion 22 of the main drive 20, it collapses the shifter biasing member 68 and the first pawl-biasing member 38, causing the first pawl 40 to completely disengage from the teeth 10 in the first chamber 8 of the housing 6.

Axial movement of the second pawl 40' occurs simultaneously with axial movement of the first pawl 40. As the shifter 60 causes the shifter yoke 50 to move the first pawl 40 toward the housing cover portion 26 of the main drive 20, the second pawl-biasing member 38' forces the second pawl 40' into engagement with the teeth 10' in the second chamber 8' of the housing 6. The detention ball 84 and detention spring 86 prevent any inadvertent rotation of the selector dial 70, thus the pawls 40, 40' will remain in this position until reversed by the operator.

Counter-clockwise rotation of the selector dial 70 sets the round head wrench 2 to apply torque during counter-clockwise rotation of the wrench handle 4. As can be seen in the section view of FIG. 11, counter-clockwise rotation of the selector dial 70 allows the shifter biasing member 68 to move the shifter yoke 50, shifter 60, and second pawl 40' toward the selector dial 70, compressing the second pawl-biasing member 38'. The second pawl 40' is thus disengaged from the teeth 10' in the second chamber 8' of the housing 6.

The first pawl-biasing member 38 simultaneously forces the first pawl 40 into engagement with the teeth 10 in the first chamber 8 of the housing 6. The detention ball 84 and detention spring 86 prevent any inadvertent rotation of the selector dial 70, thus the pawls 40, 40' will remain in this position until reversed by the operator.

Rotating the handle 4 opposite the torque applying direction will allow ratcheting of the handle 4 with relation to the main drive 20. Rotation of the handle 4 in this direction removes force from the load carrying surface 46 and applies force to the ratcheting surface 48 of the pawl and housing teeth. Because of the shape of the pawls 40, 40', and the shape of the chambers 8, 8' in the housing 6, applying force to the ratcheting surface 48 of the teeth causes a sliding effect between the currently engaged pawl 40 or 40' and its respective chamber 8 or 8'. This sliding effect results in a slight axial displacement of the pawl 40 or 40' away from the chamber 8 or 8', and in partial collapse of the respective pawl-biasing member 38, 38'. Upon sufficient disengagement of the pawl teeth 43, 43' from the teeth 10, 10' in the chambers 8, 8' , a ratcheting action will occur, wherein the pawl teeth 43, 43' will continuously skip to the next set of teeth 10, 10' in the chamber 8, 8'. This ratcheting action permits relative motion of the handle 4 with respect to the main drive 20, and allows the operator to reposition the handle 4 in preparation for the next torque-applying stroke. Once rotation of the handle 4 in the ratcheting direction ceases, the pawl-biasing member 38 or 38' will force the pawl 40 or 40' to reengage the respective chamber 8 or 8' and rotation of the handle 4 in the opposite direction will again transmit torque through the main drive 20.

In a preferred embodiment of the round head wrench 2 of the present invention, the selector dial 70 may also function as a speed dial. The internal cam 76 in the selector dial 70 functions to prevent three hundred and sixty-degree rotation of the selector dial during a ratcheting direction change. Preferably, the internal cam 76 limits rotation of the selector dial 70 to approximately ninety degrees. Once the selector dial 70 has been rotated to select a ratcheting direction for the round head wrench 2, the end walls of the internal cam 76 contact the sides of the lobes 64 protruding from the shifter 60. Because the shifter 60 is coupled to the main drive 20 via the shifter yoke pins 56, the selector dial 70 rotates with the main drive 20 as the handle 4 is turned. This allows the operator to use the selector dial 70 as a speed dial. For example, when working with a long fastener or when the frictional forces between the fastener and its mating part are too slight to cause ratcheting of the round head wrench 2, the operator may turn the selector dial 70 manually, causing direct rotation of the fastener. During operation of the selector dial 70 as a speed dial, no axial displacement of the shifter 60 takes place.

This design allows for a significant improvement in the distribution of the stresses developed upon the pawl teeth 43, 43' during the torque-producing stroke of the round head wrench 2. In a conventional reversible round head ratchet wrench, torque is generally transferred through a single, or at most, a few pawl teeth. Fewer pawl teeth engaged with the housing teeth results in higher stresses on each individual pawl tooth. By distributing the stresses over all of the pawl teeth, the stress on each individual tooth is reduced, which allows for smaller components constructed of less expensive materials.

A pear head reversible ratchet wrench (pear head wrench) is disclosed in an alternate embodiment of the present invention. Two views of the assembled pear head wrench can be seen in FIGS. 12 and 12*a*. The pear head wrench 102 has a handle 104, which may be permanently or removably affixed to a housing 106. The handle 104 is provided to apply torque to a fastener, while the housing 106 functions to contain the internal components of the pear head wrench 102.

Figure 12:
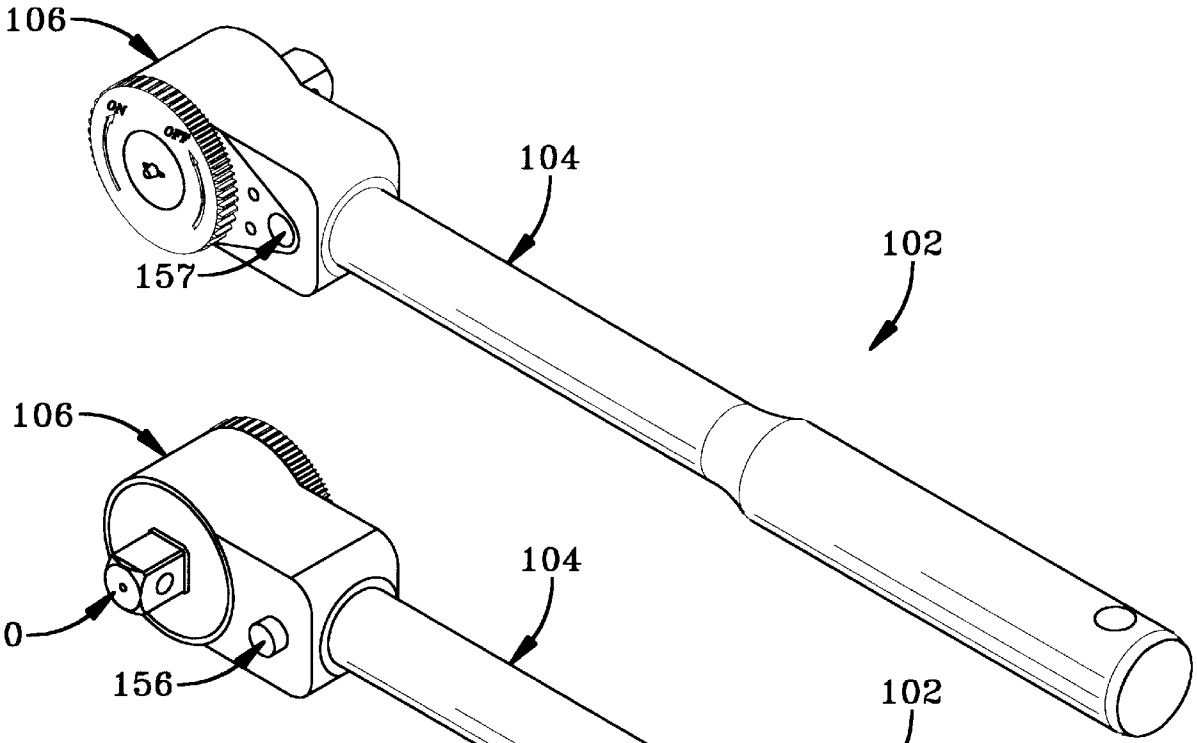
FIG. 12 shows an isometric view of the assembled, reversible pear head ratchet wrench of the present invention.
Figure 12A:
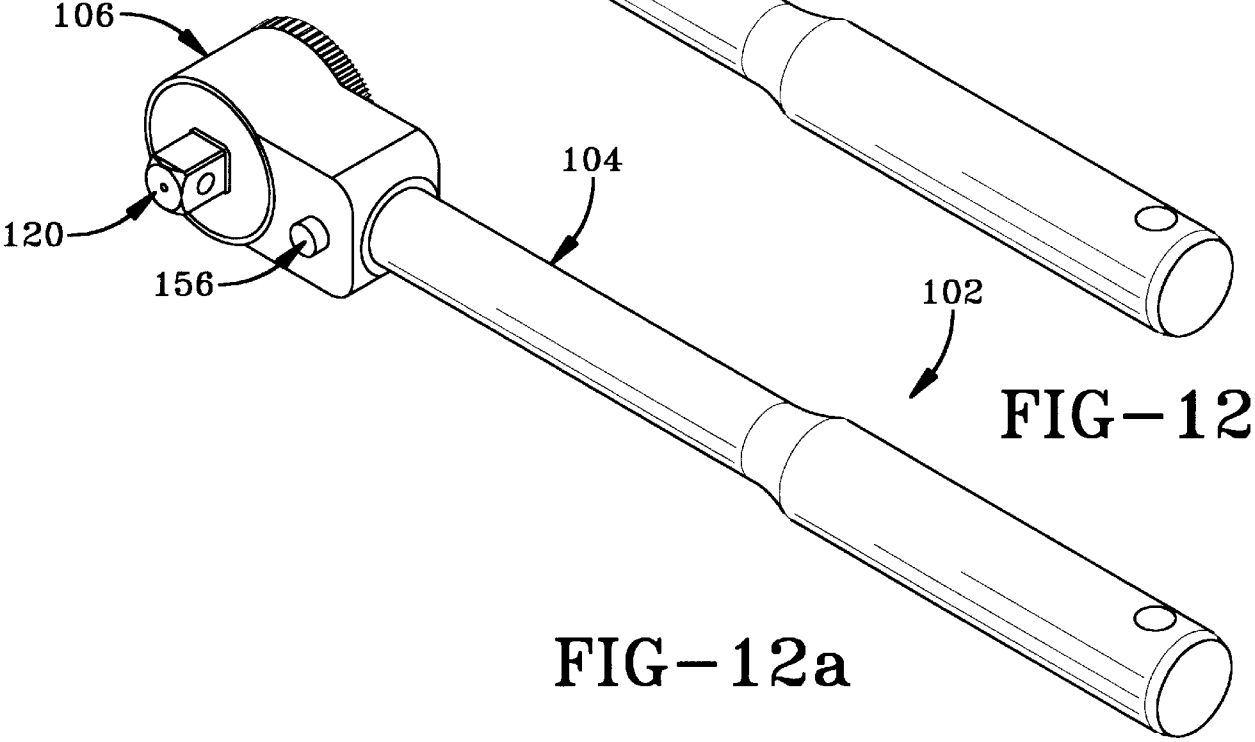
FIG. 12*a* shows a second isometric view of the assembled, reversible pear head ratchet wrench of the present invention.

In FIGS. 12 and 12*a*, a main drive 120 (FIGS. 14 and 15) can be seen protruding from one side of the housing 106 of the pear head wrench 102. The external portion of the main drive 120 is provided to releasably attach to sockets, extensions, and other drive tools. The other side of the housing 106 is preferably supplied with a housing cover 170 (FIG. 14) to seal the internal components of the pear head wrench 102 within the housing 106. In another embodiment of the pear head wrench 102, the opposite side of the housing may also adjoin a speed dial 180 (FIGS. 14 and 17) used to manually rotate a fastener without turning the wrench handle 104.

Figure 13:
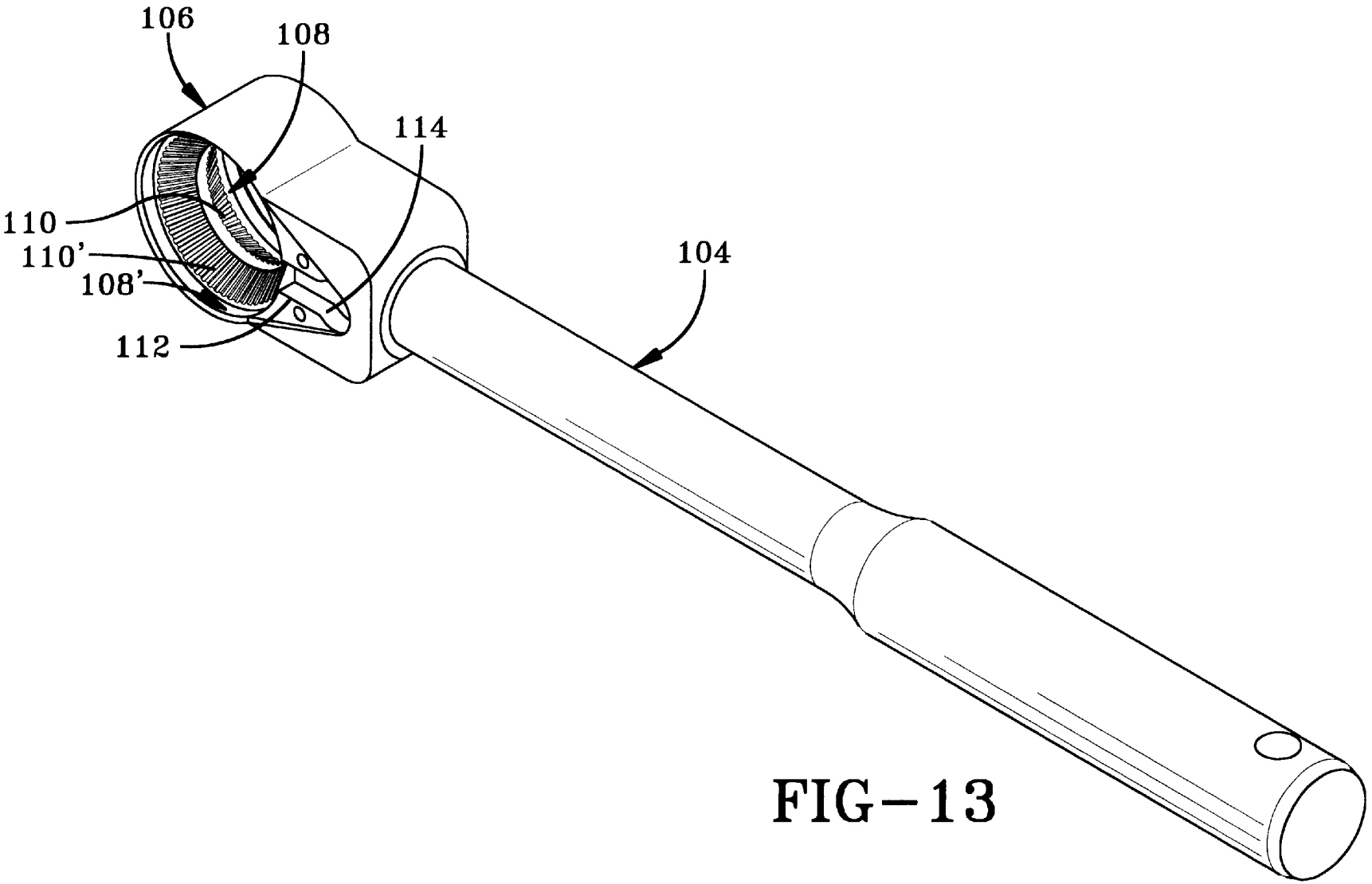
FIG. 13 is a disassembled view showing the handle and housing of the reversible pear head ratchet wrench.
Figure 16:
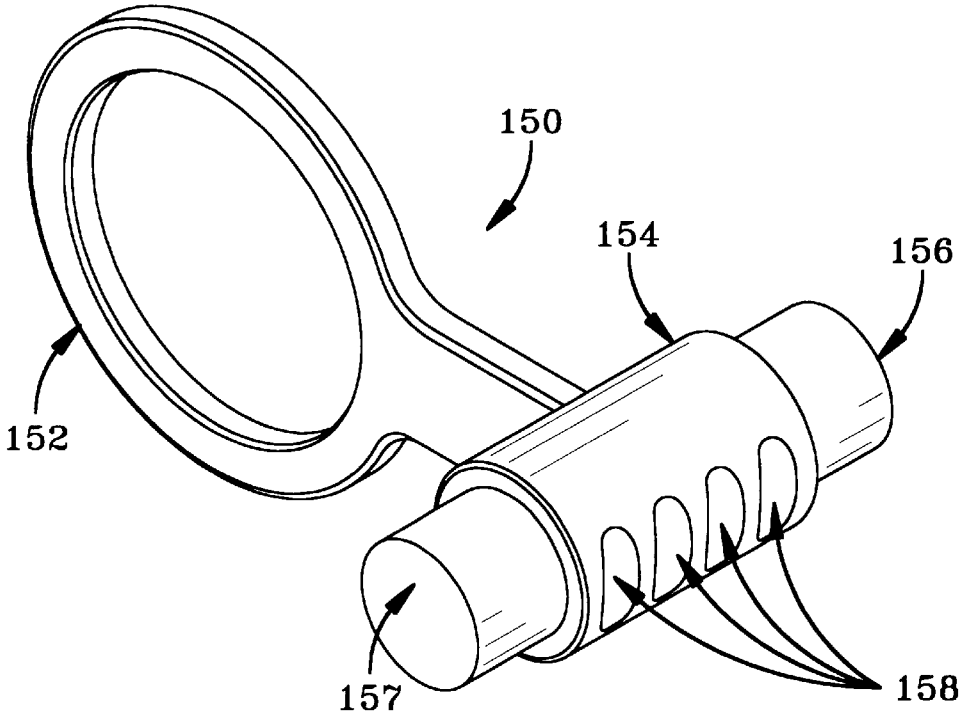
FIG. 16 shows an enlarged view of the shifter used for reversing the direction of the reversible pear head ratchet wrench.

The internal configuration of the housing 106 can be seen in the disassembled view of the pear head wrench 102 depicted in FIG. 13. The internal portion of the housing 106 has opposing chambers 108, 108' of preferably conical shape, aligned such that the larger diameter of each chamber 108, 108' is toward the outside of the housing 106. There are teeth 110, 110' formed about the inner circumference of the respective chambers 108, 108'. The side of the housing 106 adjacent to the main drive 120 contains a hole 114 for receiving a portion of a shifter 150 (FIGS. 14 and 16) used to change the ratcheting direction of the pear head wrench 102. The other side of the housing 106 has a cavity 112 for accommodating and guiding the body of the shifter 150.

Figure 14:
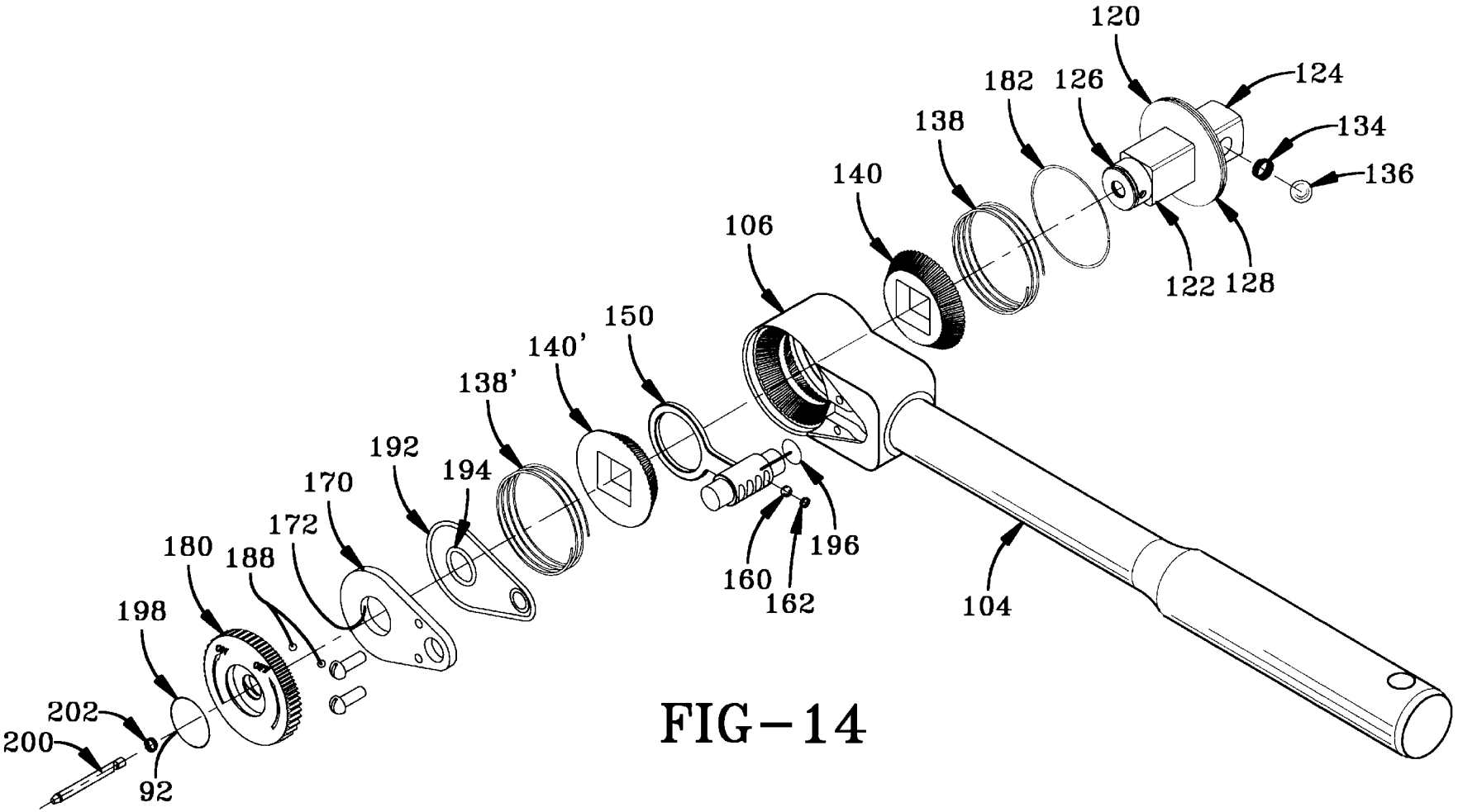
FIG. 14 is an exploded assembly view illustrating the individual components of the reversible pear head ratchet wrench.

Referring to FIG. 14, an exploded assembly view of the pear head wrench 102 of the present invention may be observed. As previously discussed, there is a main drive 120, a first portion 122 of which is inserted into the housing 106, and a second portion 124 of which protrudes from the housing for releasable attachment to sockets, extensions, or other drive tools.

Figure 15:
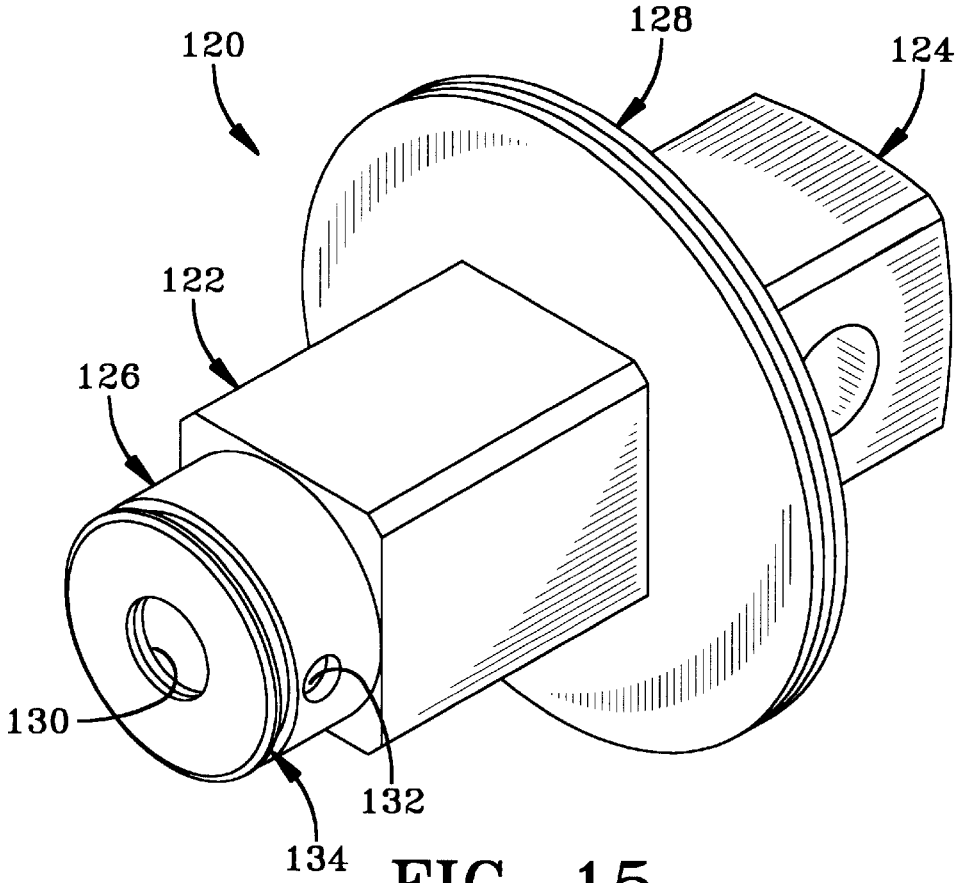
FIG. 15 is an enlarged view of the main drive utilized in the reversible pear head ratchet wrench.
Figure 17:
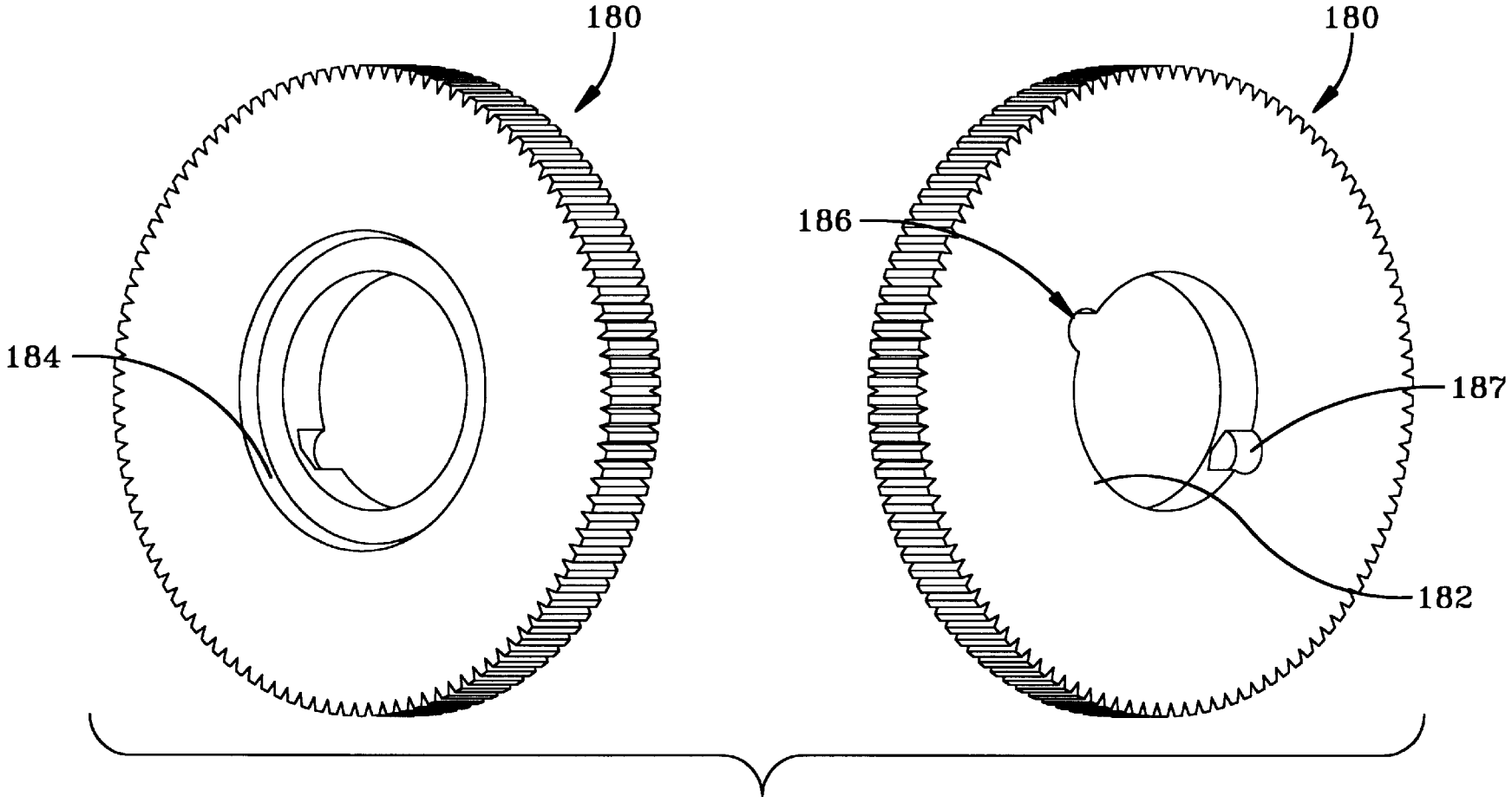
FIG. 17 depicts two views of an optional speed dial, which may be employed with the reversible pear head ratchet wrench.

An enlarged view of the main drive 120 can be seen in FIG. 15. The first portion 122 of the main drive 120 is preferably of square or rectangular configuration, but could also have some other polygonal shape. A cylindrical portion 126 extends axially from the end of the first portion 122 for engagement with, and coupling to, a housing cover 170. The cylindrical portion 126 of the main drive 120 may contain a bore 130 of some diameter, centered within its end. The bore 130 extends along the length of the first portion 122, and extends to some depth less than the overall length of the main drive 120. The bore 130 serves to house an optional quick-release mechanism (FIG. 14). The cylindrical portion 126 may have a circumferential groove 134 toward one end for engaging a drive-retaining device 198 (FIG. 14). There may also be at least two cavities 132 located at predetermined intervals around the circumference of the cylindrical portion 126. The cavities 126 are each shaped and located to receive a portion of a detention ball 188 (FIG. 14) located in the speed dial 180 (FIGS. 14 and 17).

The second portion 124 of the main drive 120 is also preferably of square or rectangular shape, as would be recognized as standard by one skilled in the art for attachment to sockets, extensions, and other drive tools. As is common, the second portion 124 of the main drive 120 may contain a spring 134 and ball bearing 136 (FIG. 14) to assist in retention of any attached components.

The main drive 120 also has a cover portion 128, preferably in the shape of a disk of some thickness, which serves to separate the first portion 122 from the second portion 124, as well as to seal one side of the housing 106 upon assembly. To further insulate the housing and internal components from the outside environment, the cover portion 128 of the main drive 120 may be fitted with an o-ring 182 (FIG. 14).

Two preferably identical pawls 140, 140', as illustrated in FIGS. 5 and 14, are provided to transfer torque from the handle 104 to the main drive 120. The pawls 140, 140' are preferably of conical shape, and are sized to mate with the chambers 108, 108' in the housing 106, such that each of the pawl teeth is engaged with a coinciding tooth in the respective chambers.

The pawls 140, 140' of the pear head wrench 102 are preferably identical in configuration and function as the pawls 40, 40' of the round head wrench 2; therefore, reference should be made to FIG. 5 and the applicable portion of the specification previously disclosed.

A first pawl-biasing member 138, such as a spring, passes over the first portion of the main drive 120 and abuts the cover portion 128. The first portion 122 of the main drive 120 then penetrates the hole 142 in the first pawl 140. The first pawl 140 is installed on the first portion 122 of the main drive 120, such that the cavity 144 (FIG. 18) in the pawl 140 traps the first pawl-biasing member 138 against the cover portion 128 of the main drive 120.

Referring again to FIG. 14, a shifter 150 is slidably installed over the first portion 122 of the main drive 120, to lie against the other side of the first pawl 140. As shown in the enlarged view of FIG. 16, a preferred embodiment of the shifter 150 has a first portion 152 which resides within the housing 106 and serves to shift the position of the pawls 140, 140'. The first portion 152 is configured in a loop to slidably pass over the first portion 122 of the main drive 120. The shifter 150 also has a second portion 154, preferably of cylindrical configuration, which is attached to the first portion 152. While the second portion 154 is contained substantially within the housing 106, one of two sections 156, 157 of the second portion 154 is made to protrude from one side of the housing 106 upon assembly. The protruding section 156 or 157 of the second portion 154 of the shifter 150 functions as a button, allowing the operator to reverse the ratcheting direction of the pear head wrench 102. The body of the second portion 154 of the shifter 150 which remains within the housing 106 preferably has a series of notches 158 for engaging with, and releasably retaining a detention ball 160 located within the housing 106 and biased against the shifter by a detention spring 162 (FIG. 14). The detention ball 160 and detention spring 162 serve to prevent inadvertent movement of the shifter.

Referring again to FIG. 14, the assembly consisting of the main drive 120, pawl first 140, and first pawl-biasing member 138, may be inserted through one side of the housing 106. The assembly is installed such that the pawl 140 contacts the teeth 110 in the first chamber 108 of the housing 106.

The shifter 150 is installed from the opposite side of the housing 106. A second pawl 140', preferably identical to the first pawl 140, is placed into the opposite side of the housing 106 and onto the section of the first portion 122 of the main drive 120 which protrudes into the second chamber 108' of the housing 106. The second pawl 140' mates with the second chamber 108' in the housing 106, such that each of the pawl teeth is engaged with a tooth in the second chamber 108' of the housing 106. The second pawl 140' also traps the first portion 152 of the shifter 150 between itself and the first pawl 140. A second pawl-biasing member 138' fits over the first portion 122 of the main drive 120 protruding into the chamber 108', and adjoins the second pawl 140'.

A housing cover 170 seals the internal components of the pear head wrench 102 within the housing 106, and traps the second pawl-biasing member 138' against the second pawl 140'. The housing cover preferably has a hole 172, of a diameter that allows it to slidably fit over the cylindrical portion 126 of the main drive 120 which protrudes through the housing 106. A second hole 174 in the housing cover may exist for permitting the button 157 of the shifter 150 to protrude through the housing. The housing cover 170 may have additional holes 176, to allow a fastener 178, such as a screw, to pass into the housing 106 for the purpose of securing the housing cover 170 to the housing. Additionally, the housing cover 170 may be fitted with o-rings 192, 194, and 196' for further sealing the housing 106 from the outside environment.

A retaining device 198, such as a clip, is provided to attach to the circumferential groove 134 in the cylindrical portion 126 of the main drive 120 protruding from the housing cover 106. The retaining device 198 functions to hold the main drive 120 in the housing 106.

If the optional speed dial 180 is used, the speed dial is placed over the cylindrical portion 126 of the main drive 120 prior to installation of the retaining device 198. Two views of a preferred embodiment of the speed dial 180 are shown in FIG. 17. The speed dial 180 is preferably a disk of some thickness, with an axial hole 182 through its center. There is a counterbore 184 located in one side the speed dial 180. The counterbore 184 is of a depth less than the total thickness of the speed dial 180. The counterbore 184 is designed to accept the retaining device 198 used to hold the main drive 120 in the housing 106.

Preferably, the speed dial 180 also contains at least two cavities 186, 187, each for housing a detention ball 188 (FIG. 14). The cavities 186, 187 are positioned such that the detention balls will engage the mating cavities 132 located in the cylindrical portion 126 of the main drive 120 (FIG. 15). This design permits the speed dial 180 to be coupled to the main drive 120. Any manual rotation of the speed dial 180 will result in the direct application of torque to the fastener, without rotation of the handle 104. The outer circumference of the speed dial 180 may also be textured or knurled for providing a better gripping surface.

In one embodiment of the pear head wrench 102, a quick-release mechanism as shown in FIG. 14 may be installed. Quick-release mechanisms are well known in the art for releasing sockets, extensions, and other drive tools from a ratchet drive; and therefore, will not be discussed in detail here. The quick-release mechanism may consist of a quick release shaft 200, and a spring 202.

Figure 18:
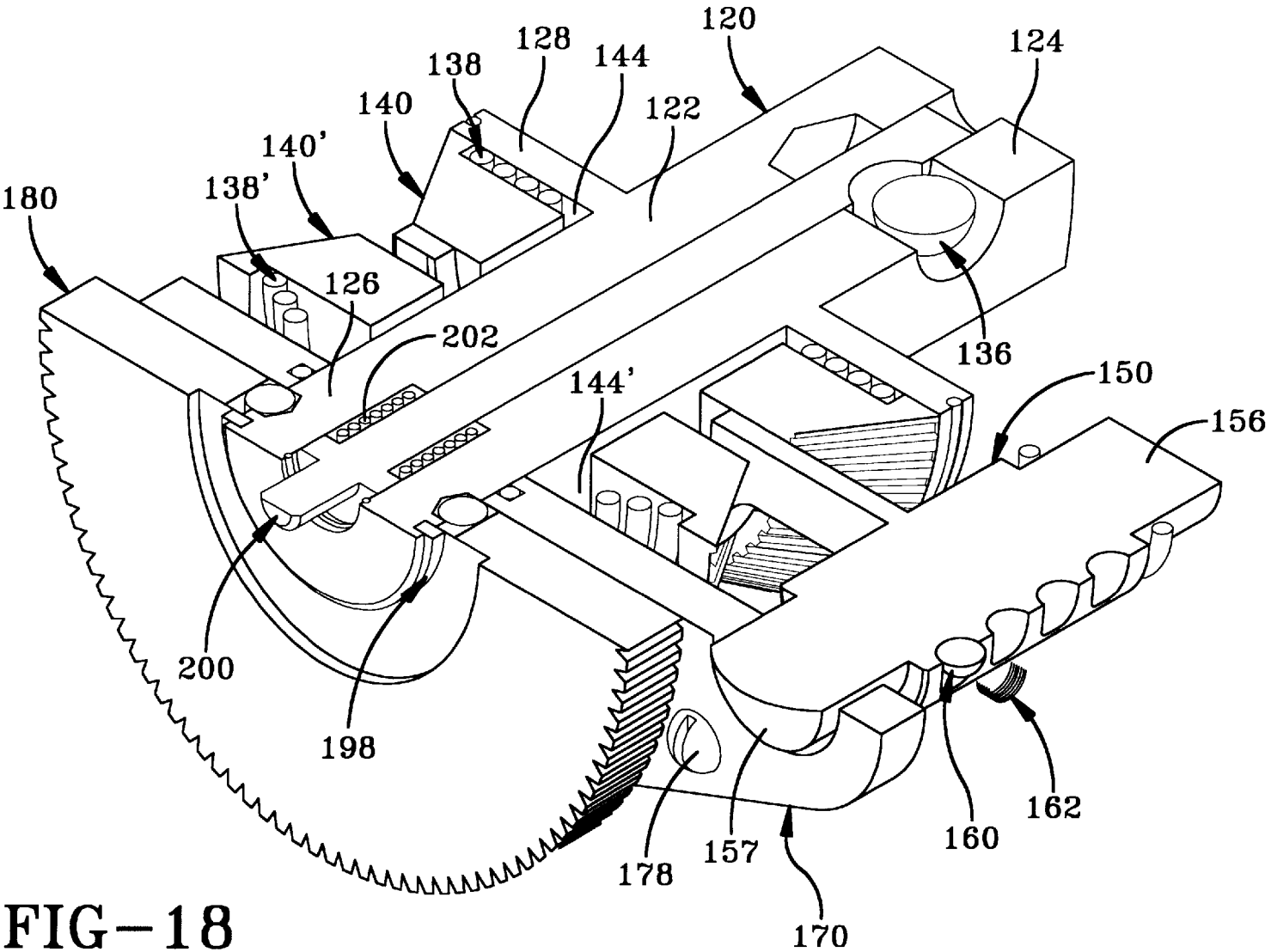
FIG. 18 is a section-view illustrating the position of the internal components, when the reversible pear head ratchet wrench is set to apply torque in a clockwise direction.

During normal operation of the preferred embodiment of the pear head wrench 102, the housing cover 170, and if used, the speed dial 180, are facing the operator. FIG. 18 is a section view depicting the position of the internal components of the pear head wrench 102 when the shifter is displaced toward the main drive 120. With the shifter 150 in this position, the pear head wrench 102 is set to transfer torque during clockwise rotation of the handle 104. Displacing the shifter 150 toward the cover portion 128 of the main drive 120 causes the first pawl 140 to move axially some predetermined distance in the same direction. When the shifter 150 reaches the position shown in FIG. 18, collapse of the first pawl-biasing member 138 occurs, allowing the first pawl 140 to completely disengage from the teeth 110 in the first chamber 108 of the housing 106.

Axial movement of the second pawl 140' occurs simultaneously with axial movement of the first pawl 140. As the shifter 150 produces movement of the first pawl 140 toward the cover portion 128 of the main drive 120, the second pawl-biasing member 138' forces the second pawl 140' into engagement with the teeth 110' in the second chamber 108' of the housing 106. The detention ball 160 and detention spring 162 prevent any inadvertent movement of the shifter 150, thus the pawls 140, 140' will remain in this position until reversed by the operator.

Displacement of the shifter 150 away from the second portion 128 of the main drive 120 sets the pear head wrench 102 to apply torque during counter-clockwise rotation of the wrench handle 104. Movement of the shifter 150 in this direction causes the second pawl 140' to slide axially toward the housing cover 170, compressing the second pawl-biasing member 138' and disengaging the second pawl 140' from the teeth 110' in the second chamber 108'. The first pawl-biasing member 138 simultaneously forces the first pawl 140 into engagement with the teeth 110 in the first chamber 108 of the housing 106. The detention ball 160 and detention spring 162 prevent any inadvertent displacement of the shifter 150, thus the pawls 140, 140' will remain in this position until reversed by the operator.

Figure 6:
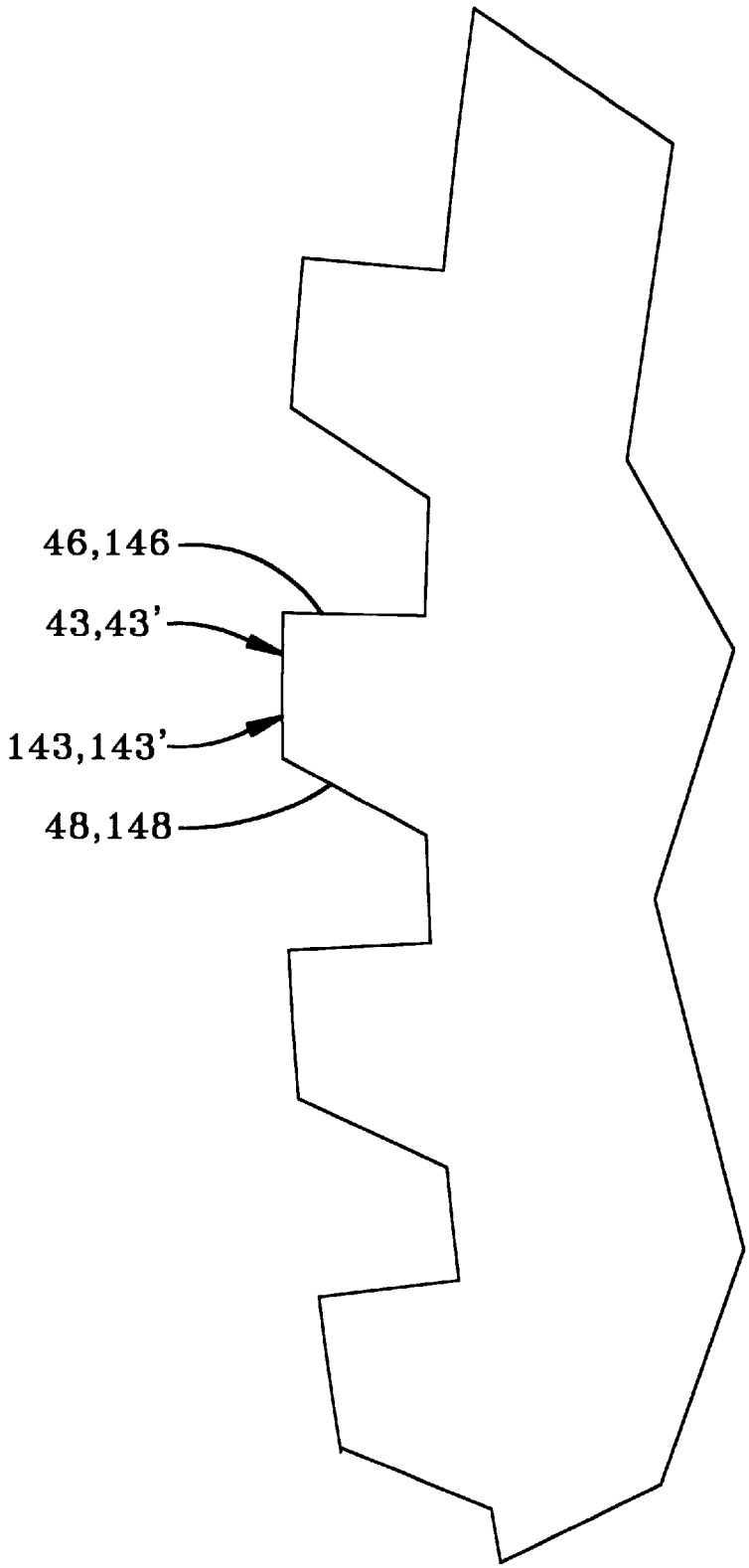
FIG. 6 is a detailed view of the tooth form utilized in both the reversible round head ratchet wrench and the reversible pear head ratchet wrench of the present invention.

Rotating the handle 4 opposite to the torque applying direction, will allow ratcheting of the handle 104 with relation to the main drive 120. Rotation of the handle 104 in this direction removes force from the load carrying surface 146 and applies force to the ratcheting surface 148 of the pawl and housing teeth (FIG. 6). Because of the shape of the pawls 140, 140', and the shape of the chambers 108, 108' in the housing 106, applying force to the ratcheting surface 148 of the teeth causes a sliding effect between the currently engaged pawl 140 or 140' and its respective chamber 108 or 108'. This sliding effect results in a slight axial displacement of the pawl 140 or 140' away from the chamber 108 or 108', and partial collapse of the respective pawl-biasing member 138, 138'. Upon sufficient disengagement of the pawl teeth 143, 143' from the teeth 110, 110' in the chambers 108, 108', a ratcheting action will occur, wherein the pawl teeth 143, 143' will continuously skip to the next set of teeth 110, 110' in the chamber 108, 108'. This ratcheting action permits relative motion of the handle 104 with respect to the main drive 120, and allows the operator to reposition the handle 104 in preparation for the next torque applying stroke.

Once rotation of the handle 104 in the ratcheting direction ceases, the pawl-biasing member 138 or 138' will force the pawl 140 or 140' to reengage the respective chamber 108 or 108', and rotation of the handle 104 in the opposite direction will again transmit torque through the main drive 120.

This design allows for a significant improvement in the distribution of the stresses developed upon the pawl teeth 143, 143' during the torque-producing stroke of the pear head wrench 102. In a conventional reversible pear head ratchet wrench, torque is generally transferred through a single, or, at most, a few pawl teeth. Fewer pawl teeth engaged with the housing teeth, results in higher stresses on each individual pawl tooth. By distributing the stresses over all of the pawl teeth, the stress on each individual tooth is reduced, which allows for smaller components constructed of less expensive materials. The ability to use smaller internal components allows for a reduction in the size of the housing 106, which in turn permits the pear head wrench 102 of the present invention to be used in more restricted work spaces than would normally be possible.

The present invention also allows the round head wrench 2 and the pear head wrench 102 to share several common components. For purposes of illustration and not limitation, the wrenches may use the same pawls, pawl-biasing members, and quick release mechanism, as well as, several common O-rings. The sharing of components between a round head wrench and a pear head wrench is usually impossible due to differences in design and construction. The sharing of components is beneficial because fewer components need be designed, produced, or maintained in inventory.

The scope of the invention is not to be considered limited by the above disclosure, and modifications are possible without departing from the spirit of the invention as evidenced by the following claims:

What is claimed is:

1. A ratchet device comprising:

a housing having internal teeth;

a main drive having a first portion for engaging a first and second pawl, said main drive provided for outputting the rotation of said ratchet device;

first and second pawls for engaging said teeth in said housing;

first and second pawl-biasing members, one of said pawl-biasing members for biasing each of said first and second pawls toward said housing;

a shifter fog axially disengaging one of said first and second pawls from said teeth in said housing; and a selector for selecting the ratchet direction;

wherein said ratchet device is adapted such that when one of said first and second pawls is disengaged from said teeth in said housing, the other of said first and second pawls is engaged with said teeth in said housing.

2. The ratchet device of claim 1 further comprising a shifter yoke, releasably coupled to said shifter, said shifter yoke for displacing one of said pawls axially away from said housing.

3. The ratchet device of claim 1 wherein said selector is releasably coupled to said shifter, said selector changing the ratchet direction by axially displacing said shifter away from said housing.

4. The ratchet device of claim 1 further comprising a shifter biasing member for biasing said shifter toward said selector.

5. The ratchet device of claim 1 wherein said ratchet device is adapted such that said pawl engaged with said teeth in said housing allows said ratchet device to transmit torque in one direction while allowing the ratchet device to ratchet in the opposite direction.

6. The ratchet device of claim 1 wherein said ratchet device is adapted such that said pawl engaged with said teeth in said housing may be disengaged, allowing said previously disengaged pawl to engage said teeth in said housing, and further allowing said ratchet device to transmit torque in the opposite direction.

7. The ratchet device of claim 1 wherein said housing is substantially round.

8. The ratchet device of claim 1 wherein said housing is internally divided into two chambers, said chambers containing teeth for engaging said pawls.

9. The ratchet device of claim 8 wherein said chambers are of substantially conical shape.

10. The ratchet device of claim 9 wherein said pawls are of substantially conical shape.

11. The ratchet device of claim 1 wherein said pawls have axial holes through their centers, said axial holes shape to accomodate said first portion of said main drive.

12. The ratchet device of claim 1 wherein said pawls have teeth of a buttress tooth profile.

13. The ratchet device of claim 1 wherein said selector is coupled to said main drive such that manual rotation of said selector may cause rotation of said main drive.

14. The ratchet device of claim 1 wherein said selector has an internal cam which acts to cause axial displacement of said shifter.

15. The ratchet device of claim 1 wherein said selector is adapted to retain a detention device, said detention device for preventing inadvertent rotation of said selector.

16. The ratchet device of claim 15 wherein said main drive is adapted to engage with said detention device in said selector.

17. The ratchet device of claim 15 wherein said detention device is a ball bearing and spring.

18. The ratchet device of claim 1 wherein said selector is a dial.

19. The ratchet device of claim 1 further comprising a handle portion extending from said housing.

20. The ratchet device of claim 19 wherein said handle portion is removably attached to said housing.

21. The ratchet device of claim 19 further comprising a quick-release mechanism for releasing drive tools from said main drive.

22. A ratchet device comprising:

a housing having internal teeth;

a main drive having a first portion for engaging a first and second pawl, said main drive provided for outputting the rotation of said ratchet device;

first and second pawls for engaging said teeth in said housing;

first and second pawl-biasing members, one of said pawl-biasing members for biasing each of said first and second pawls toward said housing;

a shifter yoke for displacing one of said first and second pawls axially away from said housing;

a shifter, releasably coupled to said shifter yoke, for axially displacing said shifter yoke away from said housing;

a selector, releasably coupled to said shifter, for changing the ratchet direction by axially displacing said shifter away from said housing; and a shifter biasing member for biasing said shifter toward said selector;

wherein said ratchet device is adapted such that when one of said first and second pawls is disengaged from said teeth in said housing, the other of said first and second pawls is engaged with said teeth in said housing.

23. A ratchet wrench comprising:

a handle portion;

a housing portion attached to said handle portion, said housing portion containing internal teeth;

a ratchet device, said ratchet device further comprising:

a main drive having a first portion for engaging a first and second pawl, said main drive provided for outputting the rotation of the ratchet device;

first and second pawls for engaging said teeth in said housing;

first and second pawl-biasing members, one of said pawl-biasing members for biasing each of said first and second pawls toward said housing;

a shifter yoke for displacing one of said first and second pawls axially away from said housing;

a shifter, releasably coupled to said shifter yoke, for axially displacing said shifter yoke away from said housing;

a selector, releasably coupled to said shifter, for changing the ratchet direction by axially displacing said shifter away from said housing; and a shifter biasing member for biasing said shifter toward said selector;

wherein said ratchet device is adapted such that when one of said first and second pawls is disengaged from said teeth in said housing, the other of said first and second pawls is engaged with said teeth in said housing; and a drive-retaining device for retaining said ratchet device within said housing.

* * * * *